US010385537B1

(12) United States Patent
Nelson

(10) Patent No.: US 10,385,537 B1
(45) Date of Patent: Aug. 20, 2019

(54) VACUUM-ASSISTED HOLE DIGGER

(71) Applicant: William Titus Nelson, Henderson, NV (US)

(72) Inventor: William Titus Nelson, Henderson, NV (US)

( * ) Notice: Subject to any disclaimer, the term of this patent is extended or adjusted under 35 U.S.C. 154(b) by 139 days.

(21) Appl. No.: 15/826,398

(22) Filed: Nov. 29, 2017

Related U.S. Application Data

(60) Provisional application No. 62/427,376, filed on Nov. 29, 2016.

(51) Int. Cl.
*E02F 3/88* (2006.01)
*E02F 7/00* (2006.01)
*E02F 3/02* (2006.01)

(52) U.S. Cl.
CPC ..... *E02F 7/00* (2013.01); *E02F 3/02* (2013.01); *E02F 3/8891* (2013.01)

(58) Field of Classification Search
CPC .. E02F 3/02; E02F 3/8891; E02F 3/92; E21B 7/027; E21B 7/028
See application file for complete search history.

(56) References Cited

U.S. PATENT DOCUMENTS 2,802,689 A 8/1957 Batstone
3,103,982 A 9/1963 Henderson
3,291,231 A * 12/1966 Kammer ..... E21B 11/005 175/170
3,638,741 A 2/1972 Zizak
3,674,100 A * 7/1972 Becker ..... E21B 7/20 175/135
3,916,634 A * 11/1975 Woodruff ..... E02D 7/24 175/205
5,791,073 A 8/1998 Palmer et al.
5,826,668 A 10/1998 Kosmalski
6,000,151 A 12/1999 Hayes
6,231,270 B1 5/2001 Cacossa
6,385,867 B1 5/2002 Slabach et al.
6,470,605 B1 10/2002 Gilman et al.
6,604,304 B1 8/2003 Slabach et al.
6,751,893 B2 6/2004 Sullivan et al.
7,185,720 B1 3/2007 Menna
7,806,205 B2 10/2010 Bock
8,944,187 B1 2/2015 Cordova et al.
9,556,692 B1 * 1/2017 Cordova ..... E21B 21/16
(Continued)

*Primary Examiner* — Matthew Troutman
(74) *Attorney, Agent, or Firm* — Kenehan & Lambertsen, Ltd; John C. Lambertsen

(57) ABSTRACT

A vacuum-assisted hole digger includes a central vacuum tube extending at an upper end from a handle assembly to a digger head assembly attached at a lower end, the digger head including a scraper blade assembly within a housing formed of an orifice plate and saw blade. The orifice plate attaches to the central vacuum tube, an extraction aperture formed in the orifice plate opening into the tube. Air entry apertures formed in the orifice plate outside of the vacuum tube have a total area smaller than the area of the evacuation aperture, which obtains enhanced airflow rates through the digger housing upon connection of the upper vacuum tube opening with a vacuum source. The blade edges of the scraper blade assembly abrasively engage the soil face when digging in a manner that obtains reduction in soil particle size and enhances soil particle airflow entrainment.

16 Claims, 16 Drawing Sheets

(56) References Cited

U.S. PATENT DOCUMENTS

| | | | | |
|---|---|---|---|---|
| 2011/0088289 | A1* | 4/2011 | Maybury, Jr. ..... | E02F 3/8816<br>37/304 |
| 2015/0034393 | A1* | 2/2015 | Hutt ..... | E21B 11/005<br>175/213 |

* cited by examiner

VACUUM-ASSISTED HOLE DIGGER

RELATED APPLICATIONS

The present application claims the benefit of priority under 35 USC § 119(e) to U.S. Provisional Application No. 62/427,376 filed on Nov. 29, 2016, which is incorporated by reference herein for all that it contains.

BACKGROUND OF THE INVENTION

Field of the Invention

The present invention relates to digging tools and, more particularly, to hand operated digging tools. More specifically, the present invention relates to a vacuum-assisted digging tool utilizing a vacuum source to obtain airflow of increased velocity at the digger head and scraper blades that enhance soil breakdown into small particles entrained in the airflow.

Description of the Related Art

Powered augers and clamshell diggers are the tools of choice when digging holes in the ground that are narrow and moderately deep, (less than one foot in diameter and three to five feet in depth). The former are dangerous to use, and expensive to purchase and operate; the latter requires a great deal of manual labor.

A need continues to exist for a manual digger tool of simple construction that makes use of inexpensive and available power sources to enhance digger efficiency and lessen the amount of manual labor required when digging narrow and moderately deep holes.

SUMMARY OF THE INVENTION

One aspect of the embodiments disclosed herein is a digger utilizing a vacuum source, such as a shop vacuum cleaner, as the prime mover to extract soil when boring a hole. A length of pipe forms a vacuum extraction tube, with a digger head assembly attached to the downhole end of the pipe and a handle assembly attached to the other end of the pipe, which remains outside of the hole, where it connects with a vacuum source. The digger head assembly includes an orifice plate, a bi-metal saw blade, and a scraper assembly. The orifice plate has a plurality of apertures formed in an outer, annular ring, with a central aperture that aligns with the opening at the downhole end of the pipe.

The attached vacuum source results in airflow up the pipe, with replacement, inflow air traveling down into the hole and apertures formed in the orifice plate, entering the cavity formed by the digger head.

The moving air picks up soil particles generated by the scraping, sawing, and oscillating rotation of the digger head, with the moving air and entrained particles flowing out of the digger head through the vacuum extraction tube. The entrained particles flow to the surface and out of the hole digger housing at its connection to the vacuum source. Depending upon the design, the vacuum source either discharges the particles to the adjacent environment or collects them for later disposal.

One aspect of the embodiments disclosed herein is a vacuum-assisted hole digger. The hole digger includes a vacuum tube having a proximal end and a distal end with a through bore extending therebetween, the proximal end configured to selectively connect with a vacuum source and the distal end configured as an intake opening having an interior diameter. The hole digger also includes a digger head assembly attached to the distal end of the vacuum tube and in fluid communication therewith. The digger head assembly includes a digger housing that has an orifice plate attached to the vacuum tube, the orifice plate having formed therein a central vacuum extraction aperture, and outwardly therefrom, a plurality of air entry apertures forming an aperture array. Upon attachment of the orifice plate to the vacuum tube, the central vacuum extraction aperture aligns and is coextensive with the interior diameter of the intake opening of the vacuum tube. A saw blade is attached to and extends about the periphery of the orifice plate, and projects in a vertical manner from the attachment to the orifice plate, a terminal edge of the saw blade defining a bottom opening of the digger housing. Also included in the digger housing, a scraper blade assembly disposed within and attached to the digger housing, the scraper blade assembly having at least one scraper blade that extends toward the bottom opening of the digger housing, the scraper blade having a terminal edge defining a scraping edge that is configured to abrasively engage with a soil face upon initiation of the hole digging.

Another aspect in accordance with the embodiments disclosed herein is a vacuum-assisted hole digger that includes an elongated tube having a first end and a second end, the first end configured for selective connection with a vacuum source and the second end configured as an intake opening. The hole digger also includes an orifice plate attached to the elongated tube at the intake opening, the orifice plate having a vacuum extraction aperture centrally formed therein and a plurality of air entry apertures formed in the orifice plate at locations outward of the vacuum extraction aperture, the plurality of air entry apertures defining an array, wherein upon attachment of the orifice plate to the elongate tube, the vacuum extraction aperture is coextensive with an inner diameter of the intake opening. A housing is received about an outer periphery of the orifice plate and extending perpendicularly therefrom in a manner defining a digger housing, a terminal edge of the digger housing defining a bottom opening of the digger housing. A scraper blade assembly is received within and attached to the digger housing, the scraper blade assembly having a plurality of scraper blades, each scraper blade extending toward the bottom opening of the digger housing and each scraper blade having a terminal edge defining a scaping edge that is configured to abrasively engage with a soil face upon initiation of the hole digging.

In certain embodiments in accordance with this aspect, the vacuum-assisted hole digger further comprises a vacuum tube having a proximal end and a distal end with a through bore extending therebetween, the proximal end configured to selectively connect with a vacuum source and the distal end configured as an intake opening. A circular outer housing surrounding the vacuum tube defining an annular cavity between the vacuum tube and an inner wall of the circular outer housing, the annular cavity configured to receive atmospheric air from an open end of the circular outer housing adjacent the proximal end of the vacuum tube. A housing handle assembly connecting the vacuum tube to the outer housing at the proximal end of the vacuum tube, the housing handle assembly including a central handle joiner having a central opening through which extends the vacuum tube, the handle joiner nested within a handle assembly outer housing, the handle outer housing dimensioned to form an interference fit upon receipt of an upper section of the circular outer housing within a lower section of the handle outer housing. Also included, a digger head housing having a circular outer wall defining an upper section and a lower section, the upper section receiving a lower section of the circular outer housing, the upper section configured to form an interference fit with the lower section. The digger head housing further comprising an orifice plate support formed within the digger head housing and annularly extending to circumferential attachment to an inner surface of the outer wall of the digger head housing. An orifice plate received upon the orifice plate support, the orifice plate having a central aperture formed therein and coextensive with the intake opening of the vacuum tube, and a plurality of air entry apertures formed in the orifice plate and arranged in an outer annular section of the orifice plate, the outer annular section extending within the annular cavity of the circular outer housing. A scraper blade assembly received within the digger head housing and attached to the outer wall at a location below the orifice plate support. Also including a saw blade attached to the outer wall of the digger head housing, the saw blade positioned such that a plurality of projecting saw blade teeth extend beyond a terminal edge of the digger head housing, whereby, upon connection of the vacuum tube with a vacuum source, atmospheric air within the annular cavity of the circular outer housing initiates an airflow into the digger head housing, entraining such soil particles as are formed through action of the scraper blade assembly therewithin, entering the intake opening of the distal end of the vacuum tube prior and its subsequent exhaustion through the proximal end of the vacuum tube, removing such soil particles from the hole digger.

These and other objects, aspects, and features of the present invention will be better understood from the following description of embodiments when read in conjunction with the appended drawing figures.

BRIEF DESCRIPTION OF THE DRAWINGS

The foregoing aspects and other aspects of this disclosure are described in detail below in connection with the accompanying drawing figures in which.

DETAILED DESCRIPTION OF THE PREFERRED EMBODIMENTS

A vacuum-assisted hole digger is disclosed in the attached drawings and is described below. The embodiments are disclosed for illustration of the vacuum-assisted hole digger and are not limiting except as defined in the appended claims.

Conventional vacuum diggers rely upon high static suction and high volumetric airflow to transport dirt from the in-ground digging head to surface discharge. The present invention seeks to enhance digging efficiency through structural modifications to the digging head to enhance the natural processes of surface soil wind erosion: Higher velocities result in greater soil erosion rates, including increased partical impact velocities that create smaller soil particles, where smaller soil particles transport easier and faster.

Figure 1:
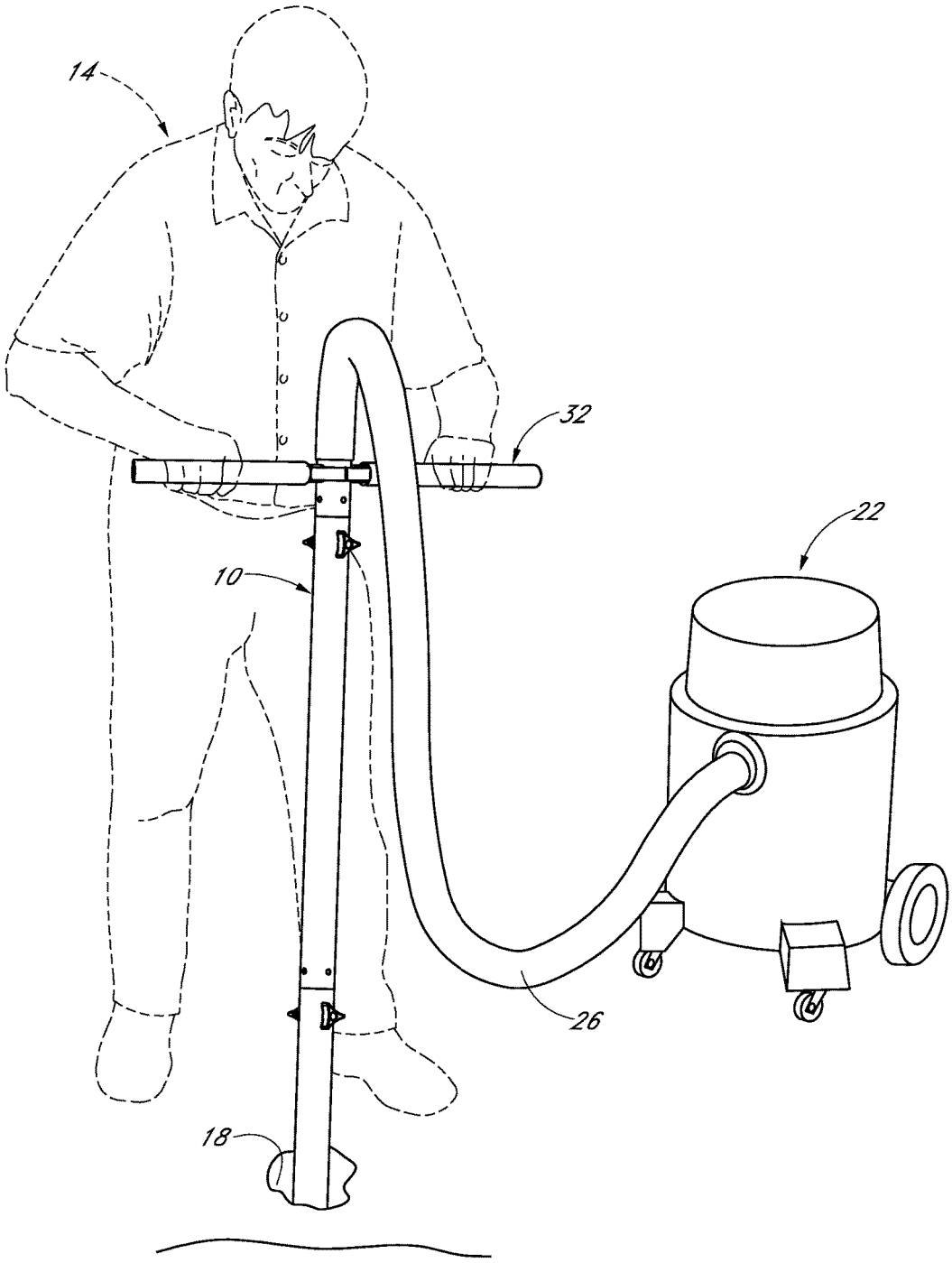
FIG. 1 is a perspective view, with portions shown in phantom, of a vacuum-assisted hole digger in accordance with the present invention, shown attached to a vacuum source and in use digging a hole.

Reference is now made to the drawings wherein like structures refer to like parts throughout. In FIG. 1 a hole digger 10 is shown as operated by a user 14 (shown in phantom) to dig a narrow and moderately deep hole 18. The hole digger 10 combines the use of two energy sources for its operation. The main energy source or prime mover is a shop vacuum 22, that pulls suction through a vacuum hose 26 connected to the hole digger 10.

The shop vacuum 22 (or another vacuum source) creates an airflow through the hole digger 10 that results in the removal of the digging cuttings, using the principles of wind erosion, as fast as they are being generated. The user 14 provides the second energy source through hand rotation of the hole digger 10 via the handle assembly 32. Downhole, the rotation of the hole digger disturbs the soil in a manner producing soil particles small enough for their lifting and removal by the vacuum-induced air stream. The removal of the cuttings prevents them from interfering with the hand rotation of the hole digger 10.

Figure 2:
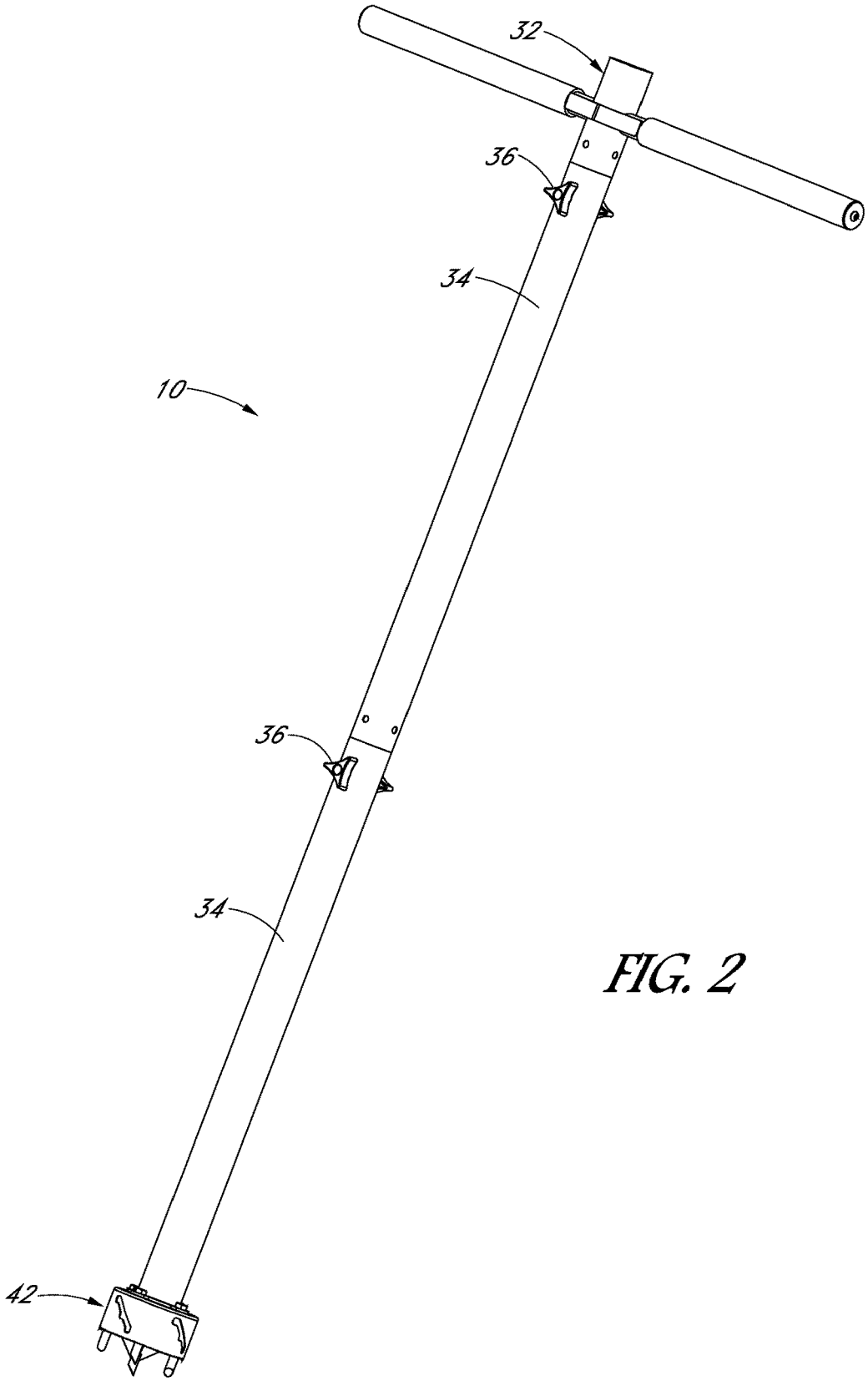
FIG. 2 is a perspective view of the hole digger disclosed herein.

FIG. 2 shows an entire length of a presently preferred embodiment of the hole digger 10. Preferably formed of a 2-inch metal vacuum tube 34 of length thirty inches and thickness of 0.49-0.65 inch. Holes of four and one-half feet or greater may be obtained by fastening together the metal vacuum tubes 34, end to end, using one or more tube connectors 36. As shown in FIG. 2, a pair of the metal vacuum tubes 34 are attached together, with the handle assembly 32 attached at one end, a proximal end, of the attached tubes 34 and a digger head assembly 42 attached at the other, downhole, or distal end, with a through bore formed by the vacuum tube extending the entire length thereof.

Figure 3:
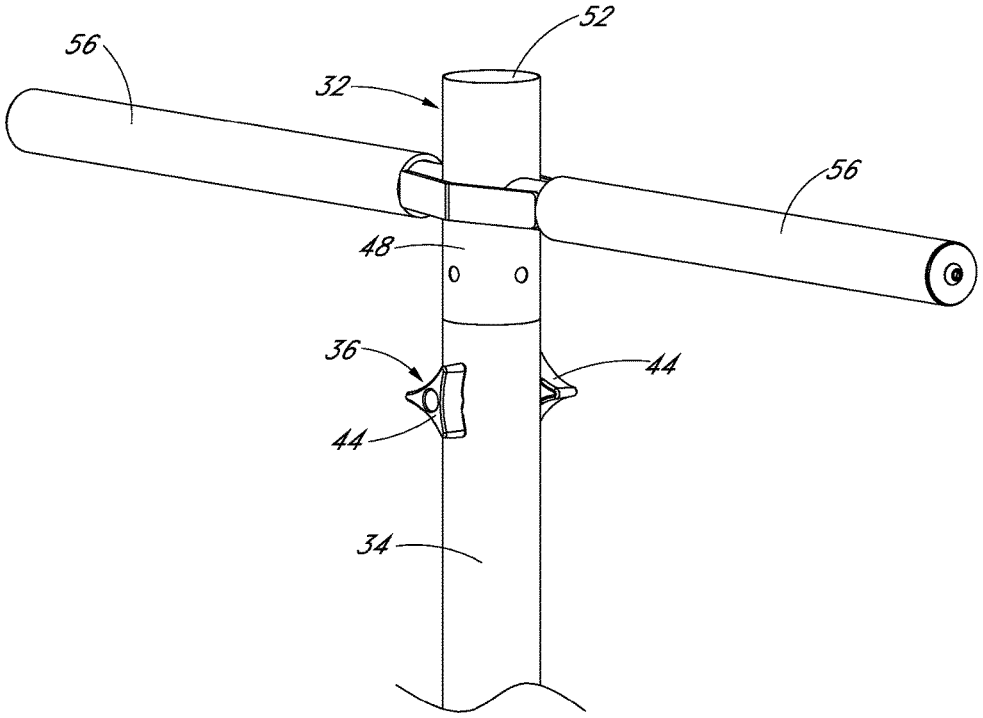
FIG. 3 is a partial perspective view of the handle assembly of the hole digger of FIG. 2.

The handle assembly 32 is shown attached to the vacuum tube 34 in FIG. 3, using tube connectors 36. In a presently preferred embodiment, an attachment screw 44 is shown with user-friendly turning knobs, connecting and securing the handle assembly 32 to the vacuum tube 34. The outer end of the handle assembly is configured as a vacuum hose adapter 52, slidably receiving the vacuum hose during operation of the hole digger.

Figure 4:
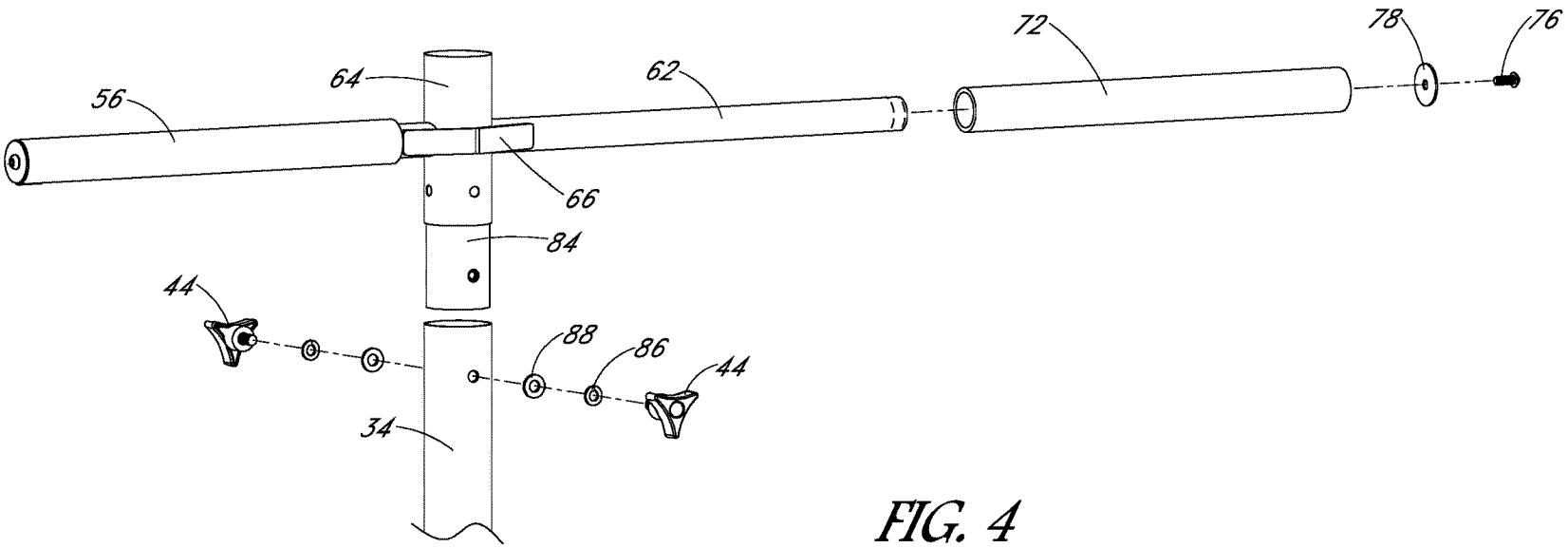
FIG. 4 is a partially exploded perspective view of the handle assembly of FIG. 3.

A pair of handles 56 extend on opposite sides of an outer sleeve 48, providing a user grip location when rotating the hole digger. Referring to FIG. 4, each handle 56 consists of an inner metal tube handle 62 of diameter one inch attached, preferably by welding, to a center vacuum tube 64 of the handle assembly. A pair of metal securement straps 66 extend between and are attached to both metal tubes, one strap on each side of the handle assembly. The metal securement straps 66 reinforce the connection of the handles 56 to the center vacuum tube 64 of the handle assembly, resisting the reciprocating torsional forces applied during operation of the hole digger.

An outer handle cover 72 is slidably received over the inner metal tube handle 62 in a manner that enables the outer handle cover 72 to rotate about the inner metal tube handle 62. In this way, a user can firmly grip the outer handle cover, without regard to movement of the inner tube handle during operation of the hole digger. A cover retainer screw 76 and retainer washer 78 secure the outer handle cover to the inner metal tube handles 62.

An attachment sleeve 84 extends from the center vacuum tube 64 enabling attachment of the handle assembly with an upper end of the metal vacuum tube 34. The two attachment screws are received on opposite sides of the vacuum tube, with an attachment lock washer 86 and an attachment washer 88 aiding to secure the connection.

Figure 5:
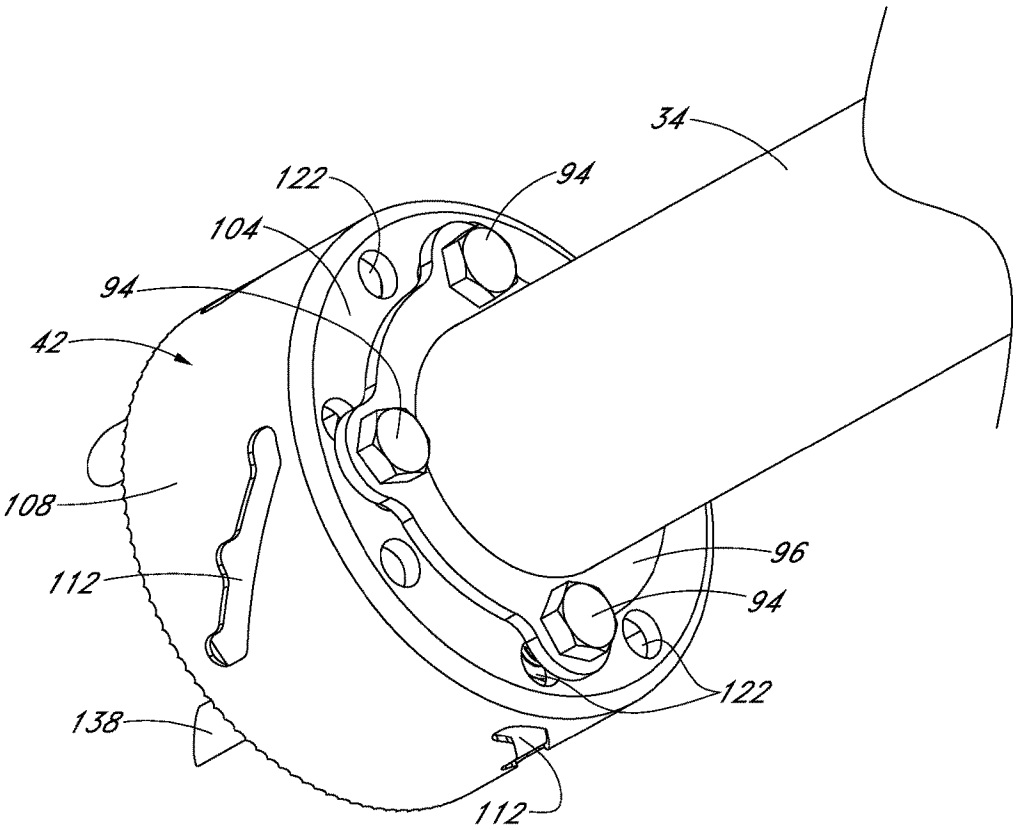
FIG. 5 is a partial top perspective view of the digger head assembly of the hole digger of FIG. 2.
Figure 6:
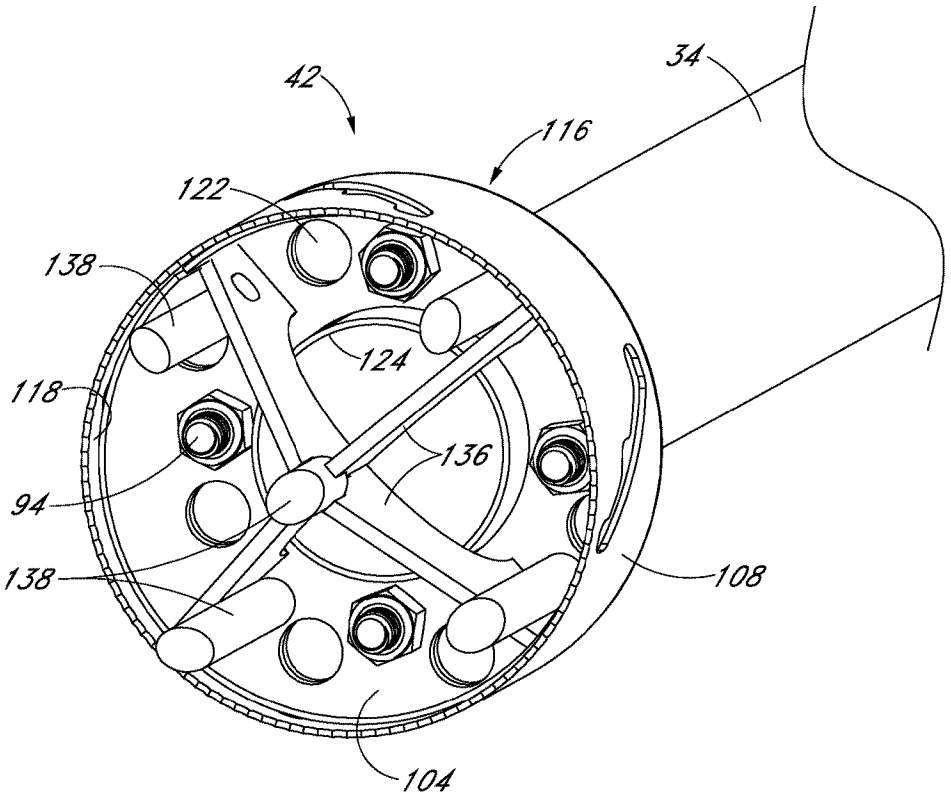
FIG. 6 is a partial bottom perspective view of the digger head assembly of FIG. 5.
Figure 7:
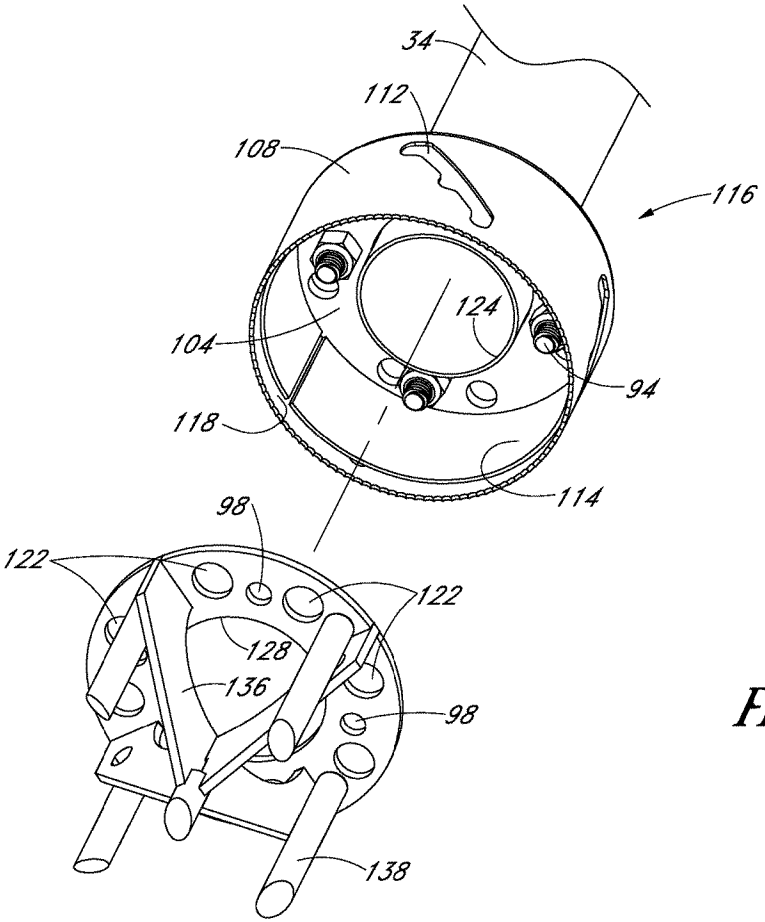
FIG. 7 is a partially exploded bottom perspective view of the digger head assembly of FIG. 5.

At the downhole end of the hole digger, the digger head assembly 42 is shown in FIGS. 5-7 as attached to the metal vacuum tube 34 using a plurality of digger head attachment bolts 94 that extend through openings formed in a universal adapter ring 96 welded to the lower vacuum tube 34, and are received by the digger head assembly through bolt holes 98 formed in an orifice plate 104. The universal adapter ring 96 enables attachment of different diameter digger head assemblies to the metal vacuum tube 34.

A saw blade 108 is attached to the outer periphery of the orifice plate, such as by welding. The saw blade 108 is preferably a bi-metal saw blade, such as those offered by such companies or under such brands as Lennox®, Cobalt®, and Milwaukee®. Such blades include a plurality of saw openings 112 formed in the blade, and when used in the present invention, a blocking ring 114 is secured to the inner surface of the saw blade to close such openings, preventing airflow therethrough. In this manner the orifice plate 104 and the attached saw blade 108, which extends or projects from its peripheral attachment to the orifice plate to form a digger housing 116 having a bottom opening 118 that is defined by a terminal edge of the saw blade.

The orifice plate 104 has a plurality of air entry apertures 122 and a central vacuum extraction aperture 128 formed therein. The plurality of air entry apertures 122 preferably form a circular outer array about the central vacuum extraction aperture 128, and are preferably identical in diameter. Upon attachment of the metal vacuum tube 34, the central vacuum extraction aperture aligns with and is preferably coextensive with the interior diameter of an intake opening 124 formed at the downhole end of the metal vacuum tube, enabling the unrestricted flow of air from within the digger head into the metal vacuum tube during operation of the hole digger.

As shown in FIGS. 5-7, the plurality of air entry apertures 122 lie outside the metal vacuum tube. During operation of the hole digger, atmospheric air enters the digger head assembly through the plurality of air entry apertures 122. The size of each of the plurality of air entry apertures is selected such that the combined area of all of the plurality of air entry apertures is less than the area of the central vacuum extraction aperture 128. During operation, air entering through each of the plurality of air entry apertures will flow toward the central vacuum extraction aperture at increasing velocity. In addition, the air pressure within the digger head will lie between that of the air entering through the air entry apertures (typically atmospheric) and that of the air pressure within the metal vacuum tube 34.

A plurality of scraper blades 136 are attached to and extend from the saw blade 108 within the digger head assembly 42. The scraper blades act on the soil face within the digger head assembly to break down the soil particles into ever smaller size. The higher velocity airflow discussed above more easily entrains such reduced-size particles, and then removed from within the digger head by the airstream flow into the metal vacuum tube 34.

In a presently preferred embodiment, the orifice plate is provided with a plurality of air entry apertures that are equal to twice the number of scraper blades, and is positioned relative to the plurality of scraper blades such that a pair of air entry apertures are located above and adjacent each of the plurality of scraper blades, one air entry aperture positioned over each side of each of the plurality of scraper blades (preferably the scraper blades are centered between the two air entry apertures).

During operation of the digger, airflow from the air entry apertures moves along the leeward or trailing edges of each of the plurality of scraper blades during rotation of the digger head assembly, with the soil particles accumulating in front of the scraper blades, eventually topping the blade and falling over to the leeward side, becoming entrained in leeward or trailing edges airflow, and transported toward and into the central vacuum extraction aperture. In a presently preferred embodiment, arrangement of the plurality of scraper blades forms a cross at the axial center of the vacuum extraction aperture, thereby focusing airflow from the plurality of air entry apertures toward the central vacuum extraction aperture.

The digger head assembly of FIGS. 5-7 also includes a plurality of scraper dowels 138 to enhance the ability of the digger head to dig in and break up the soil as the digger head oscillates in its direction of rotation during operation. Preferably, the scraper dowels have a projecting end that is cut at an angle to decrease the surface area of the soil engagement surface. Enhancement of scraper dowel efficiency is obtained by their placement along a common radius at alternating inboard and outboard locations. Also, it is presently preferred that the combined cross-sectional area of the soil engagement surfaces of the scraper dowels is less than the combined cross-sectional area of the scraper blade edges.

Figure 8:
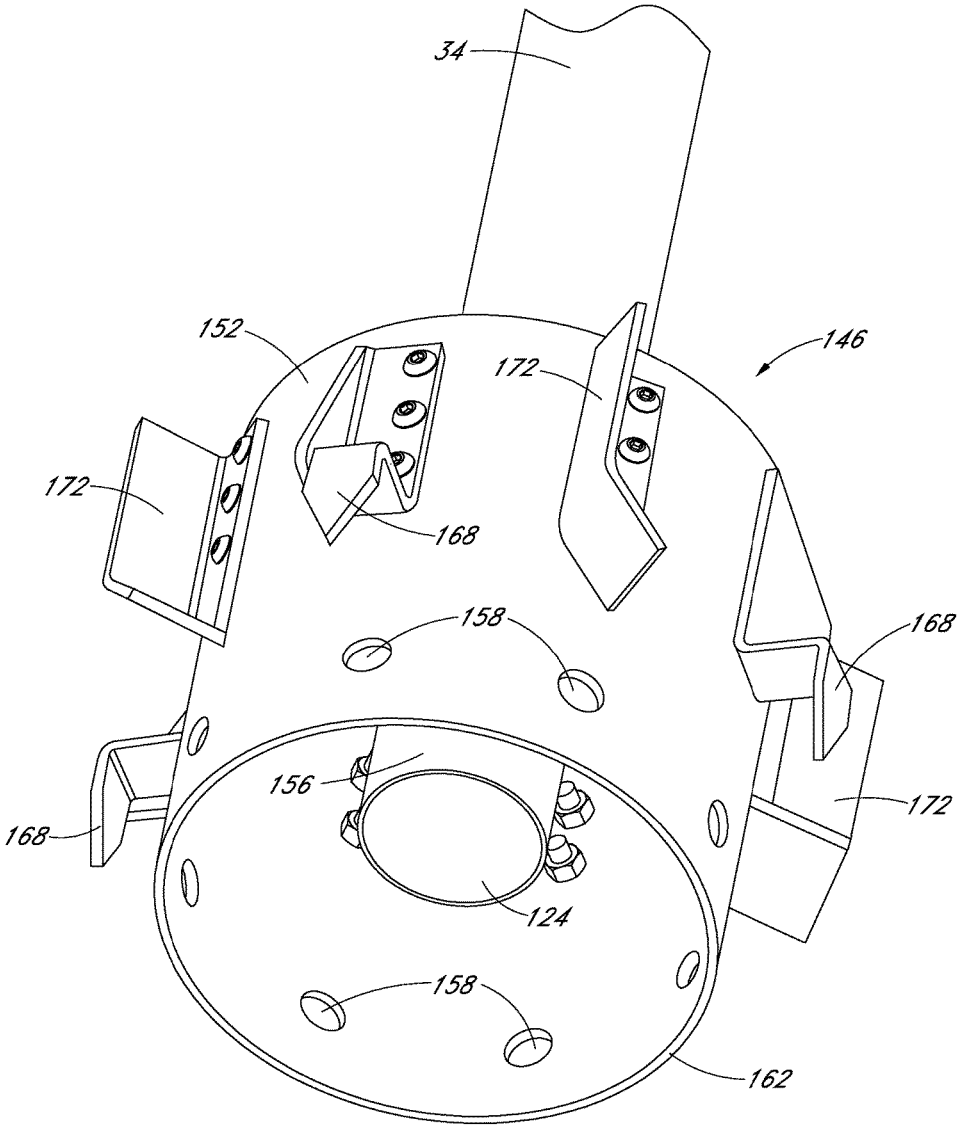
FIG. 8 is a partial bottom perspective view of a reamer head assembly as an alternate embodiment of the hole digger of FIG. 2.
Figure 9:
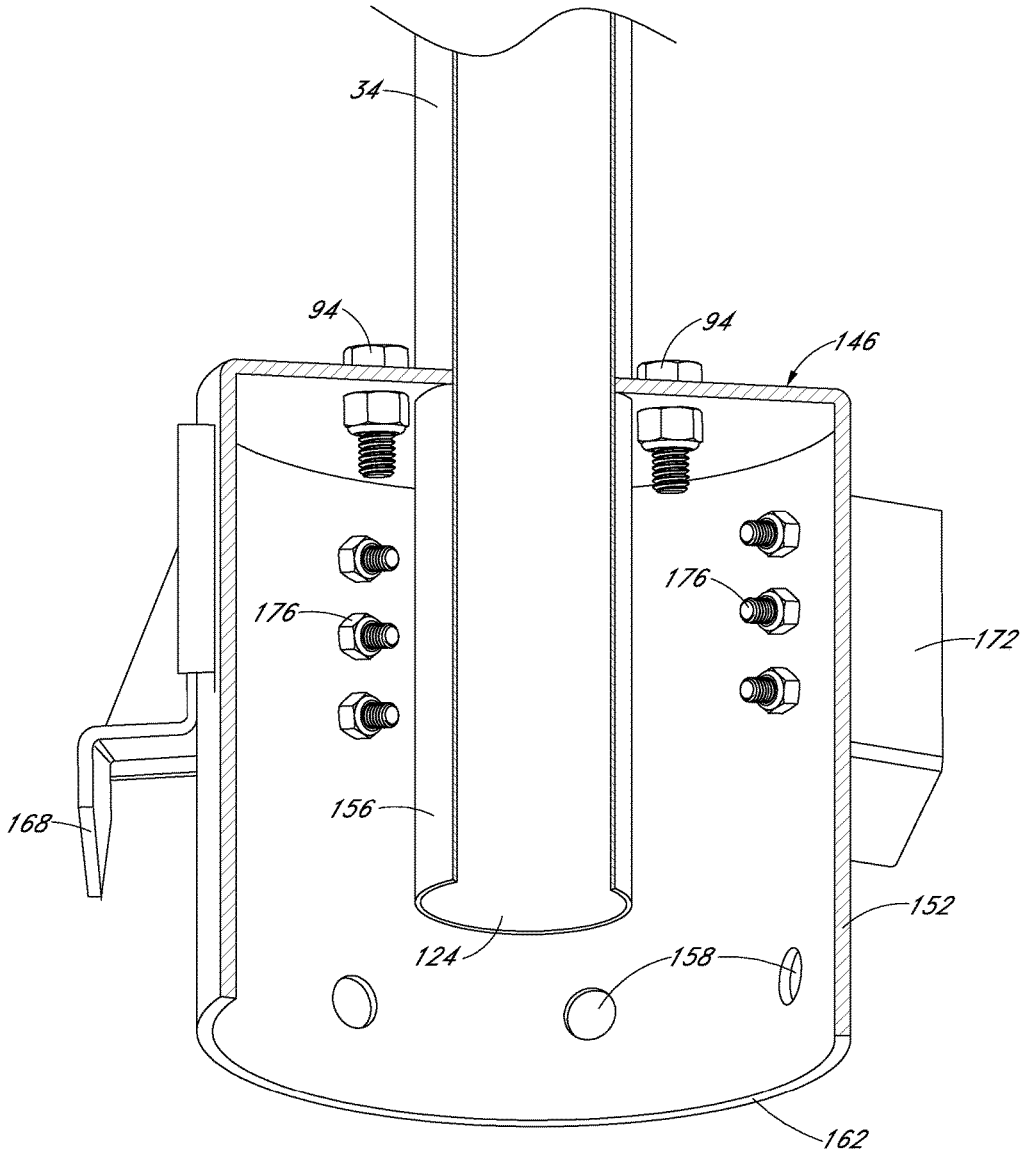
FIG. 9 is a partial cross-sectional view of the reamer head assembly of FIG. 8.

Digger head assemblies having diameters larger than six inches are increasingly more difficult to rotate and take longer to excavate holes. When holes of larger diameter are desired, the hole is first dug at a six-inch diameter, and then reamed to eight, ten, or twelve inches, making use of a reamer assembly 146, such as is shown in FIGS. 8 and 9.

A reamer head 152 of extended length is attached to the downhole end of the metal vacuum tube 34, preferably using the universal adapter ring 96 discussed above (not shown in FIGS. 8 and 9) using the digger head attachment bolts 94. The universal adapter ring is attached to the metal vacuum tube at a displaced distance from the end of the tube, forming an extended suction tube 156 within the reamer head assembly.

An annular array of air entry apertures 158 are formed in the reamer head 152 at a spaced distance from a terminal edge 162. During operation of the digger, atmospheric air enters the reamer head through the annular array of air entry apertures and flows toward the intake opening 124 of the extended suction tube 156. As discussed above, increased air velocities are obtained by constraining the total area of the air entry apertures 158 to a total that is less than the area of the intake opening 124.

Reaming of the outer hole occurs using a plurality of reamer saw blades 168 and a plurality of reamer scraper blades 172, both projecting from the outer surface of the reamer head 152. Blade mounting hardware 176 is a presently preferred manner of their attachment and is shown in FIG. 9 as bolts and nuts. The particles generated by the reamer saw blades, and reamer scraper blades (not shown in FIGS. 8 and 9) fall into the hole as it is reamed down.

The particles accumulate until encountered by the terminal edge of the reamer head assembly. The particles block further airflow from entering the bottom of the reamer head assembly, forcing air entry through the annular array of air entry apertures. Air velocity increases entraining soil particles in the airstream, which flows into the extended suction tube and then through the metal vacuum tube. The user can continuously ream to the bottom of the hole while extracting the reamed cuttings.

Figure 10:
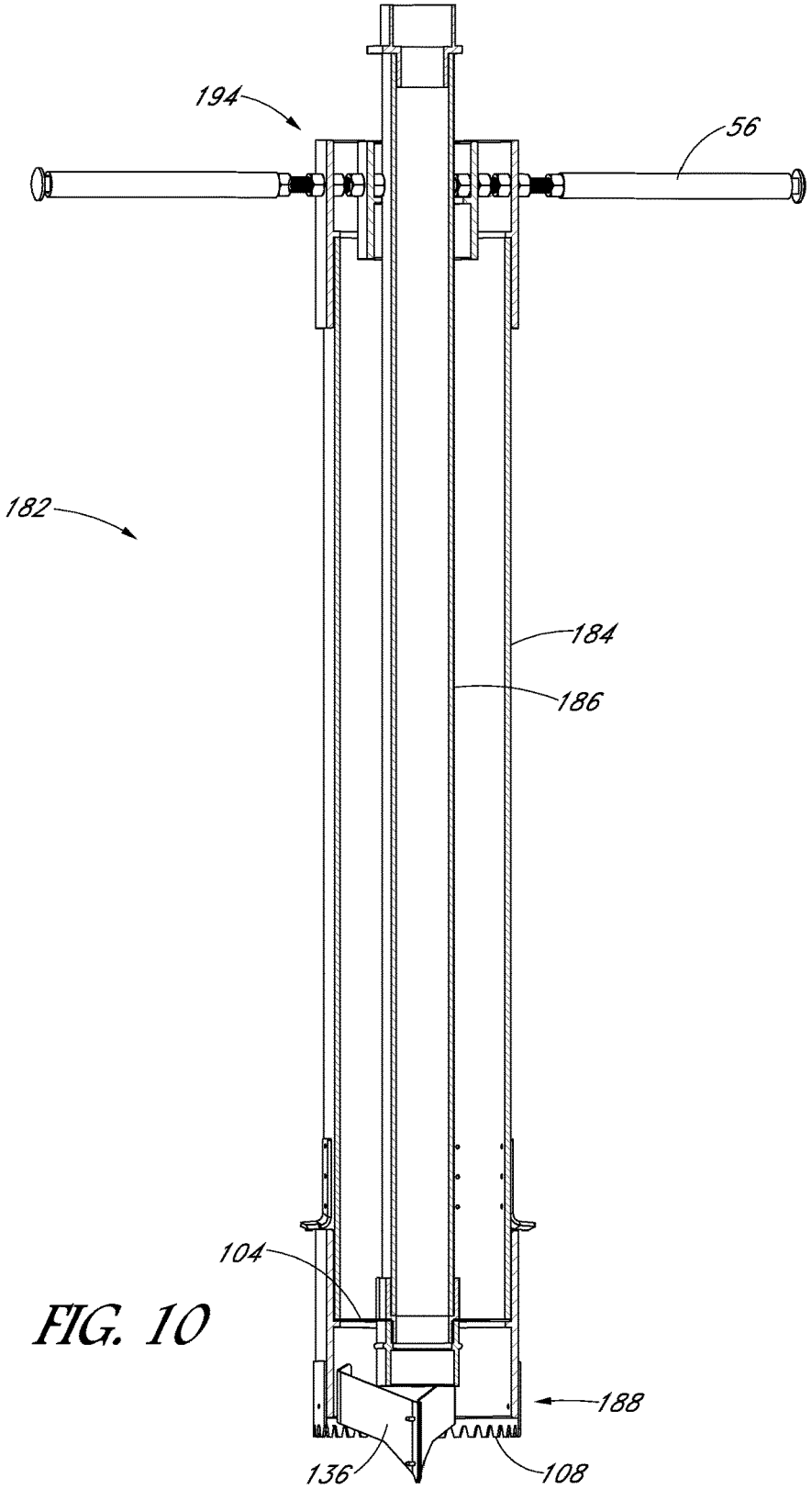
FIG. 10 is a side elevation, cross-sectional view of an alternative embodiment of the hole digger of FIG. 2.

A presently preferred alternative embodiment of a hole digger is shown in FIG. 10. An outer housing hole digger 182 utilizes a circular outer housing 184 to surround the central vacuum tube 186, with atmospheric air flowing down within the outer housing 184 to the digger head housing 188, with entry into the digger head through apertures (not shown) formed in an orifice plate 104.

In a presently preferred embodiment, the outer housing hole digger 182 shown in FIG. 10 utilizes a six-inch PVC sewer pipe as the circular outer housing 184, which provides a backbone of structural strength and support for attachment of the housing handle assembly 194 and the digger head housing 188. In addition, the circular outer housing 184 provides support for the central vacuum tube 186 and the orifice plate 104. As discussed previously, the orifice plate enables regulating a pressure differential within the digger head, and the saw blade 108 enables forming a uniform hole diameter.

Figure 11:
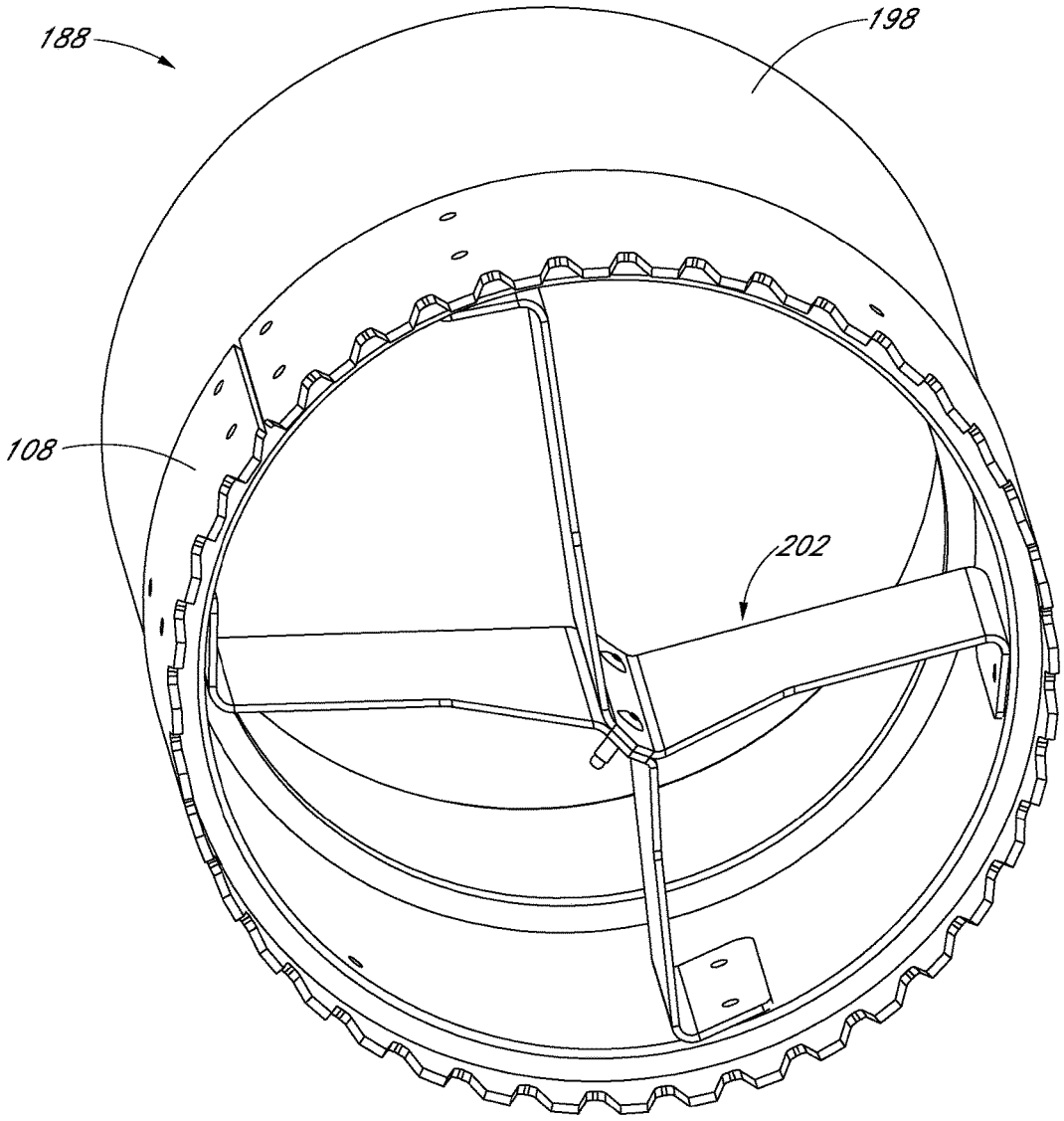
FIG. 11 is a bottom perspective view of the digger head assembly of the hole digger of FIG. 10.

Assembly of the digger head housing 188 shown in FIG. 11 utilizes a six-inch PVC coupling 198. The main components are a housing scraper blade assembly 202, having a centering point 204, the housing scraper blade assembly 202 scrapes the soil surface and produces soil particles as rotates back and forth in a clockwise and counterclockwise manner during operation. In a presently preferred embodiment, the saw blade 108, and the housing scraper blade assembly 202 are attached to the PVC coupling 198 using such fasteners as rivets, screws, or other, like means.

Figure 12:
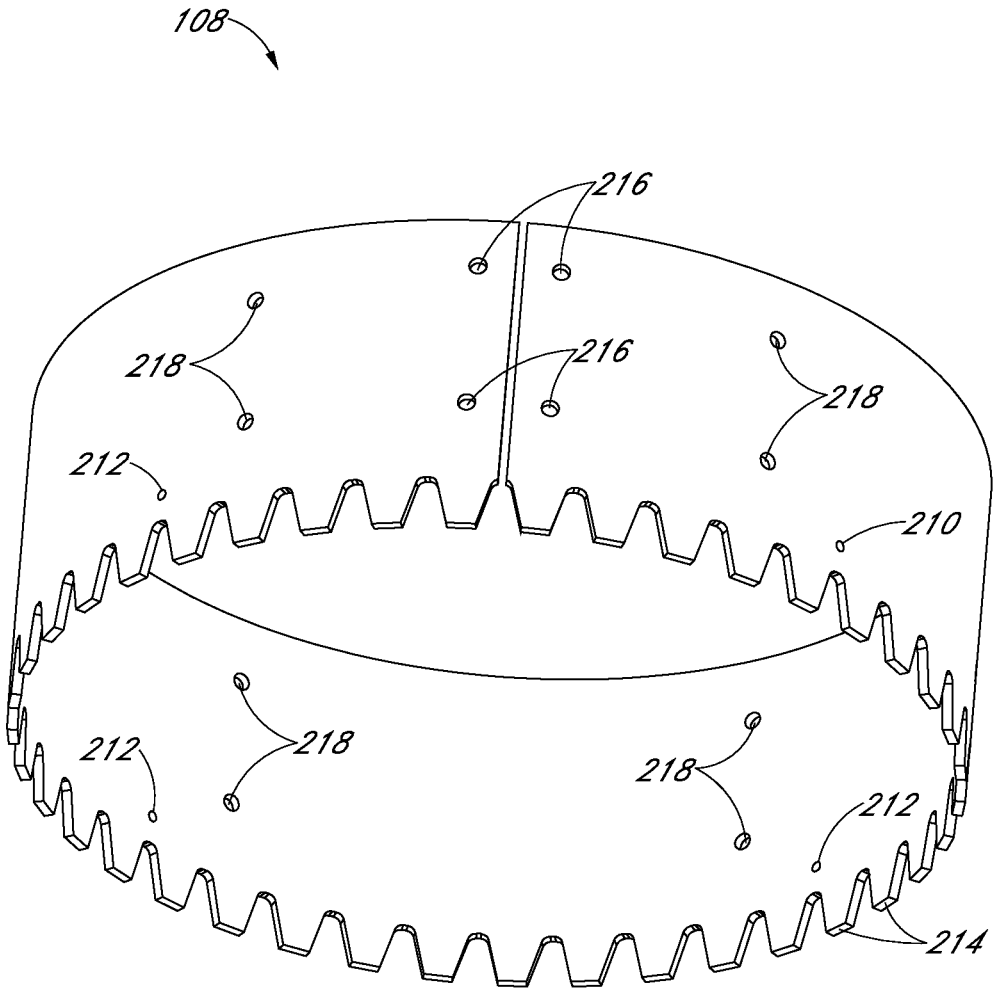
FIG. 12 is a bottom perspective view of the circular saw blades of the digger head assembly of FIG. 11.

The positioning of the saw blade 108 on the PVC coupling 198 is best described with reference to FIG. 12. The saw blade 108, initially of rectangular configuration, is wrapped around the end of the PVC coupling 198 (not shown in FIG. 12), with attachment and positioning aided by apertures formed in the saw blade. A plurality of vertical positioning apertures 212 form an array in the saw blade near the array of saw teeth 214 to assist in vertically positioning the saw blade from the edge of the PVC coupling. A plurality of attachment apertures 216 form an opposing array in the saw blade at each end thereof, with fasteners (not shown) received within the apertures attaching the saw blade to the PVC coupling. A plurality of scraper blade attachment apertures 218 are formed in the saw blade at spaced locations corresponding to attachment locations for the housing scraper blade assembly (not shown).

Figure 13:
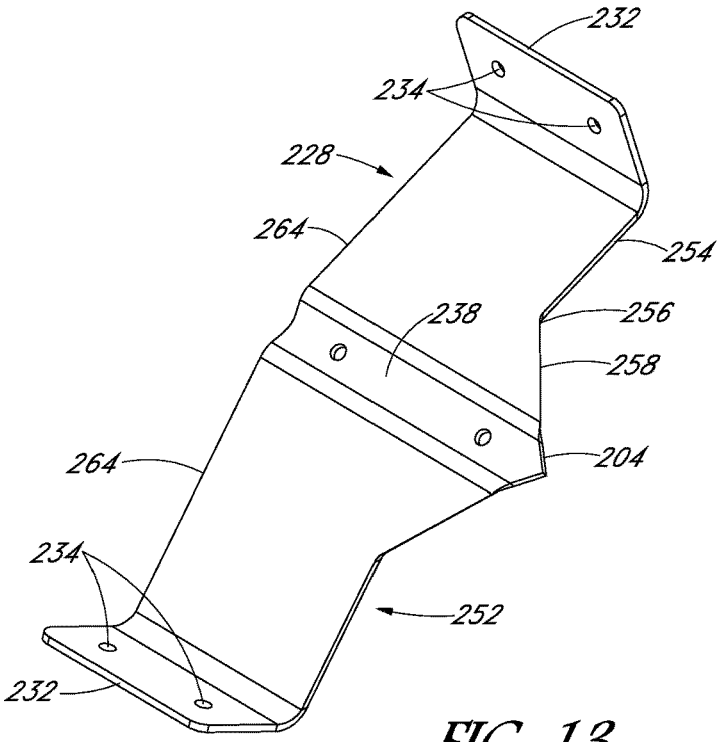
FIG. 13 is a perspective view of one of the scraper blades in the digger head assembly of FIG. 11.
Figure 14:
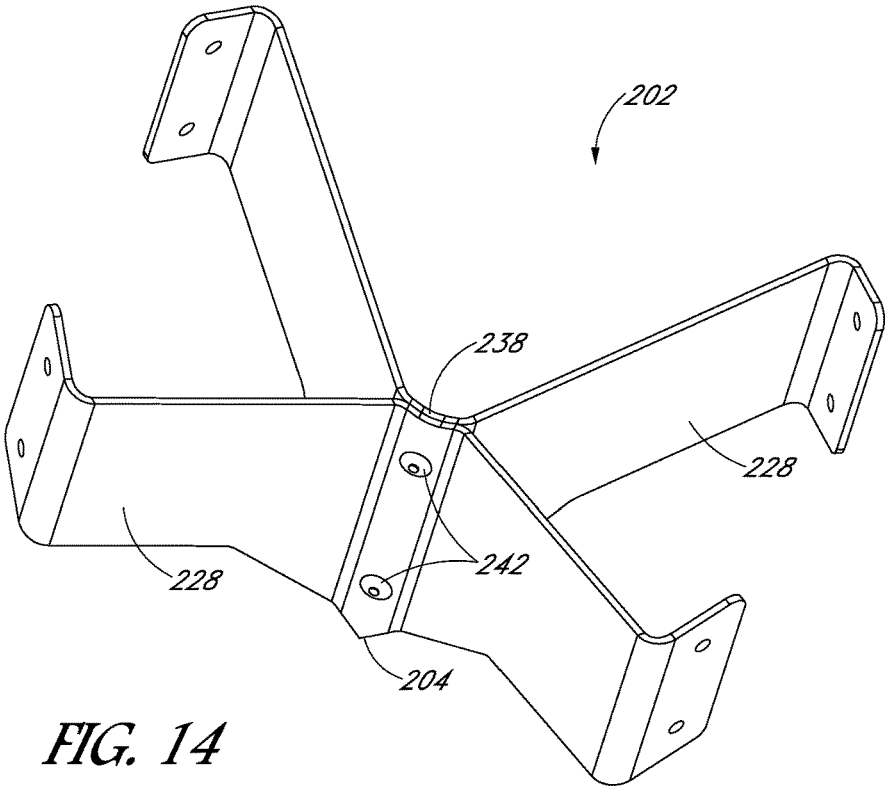
FIG. 14 is a perspective view of the scraper blade assembly that includes a pair of the scraper blades of FIG. 13.

FIGS. 13 and 14 show the digger head housing scraper blade 228 and the housing scraper blade assembly 202. The housing scraper blade has a pair of attachment flanges 232 formed at each end, with a pair of attachment flange apertures 234 formed in each attachment flange, the attachment flange apertures receive fasteners toward attachment of the housing scraper blade assembly 202 to the saw blade and PVC coupling. A flattened joining surface 238 is formed along a central axis of the housing scraper blade, with the housing scraper blade assembly formed upon attachment of two housing scraper blades at their respective flattened joining surfaces, as shown in FIG. 14, with the connection secured using a pair of joining fasteners 242.

The top and bottom edges of the housing scraper blades perform distinct functions toward enhancing the performance of the hole digger. The bottom edges form a scraping edge 252 that preferably extends from the attachment flange in a manner forming a horizontal segment 254 extending to an inflection point 256, with a centering point segment 258 angled downward from that place.

As so configured, the soil particles generated by the scraping edge 252 move toward the centering point of the housing scraper blade assembly. The top edge of the housing scraper blade forms a windward edge 264. During operation, the soil particles accumulate against the housing scraper blade until reaching the windward edge. Further accumulation results in the soil particles pressing over the windward edge, and falling down the other side of the scraper blade, where those of certain size and weight are entrained in air flowing up that same side of the scraper blade. Such manner of soil particle fall enhances the number of soil particles entrained in the airflow, which then travels out of the digger head and into the central vacuum tube for discharge from the digger.

Figure 15:
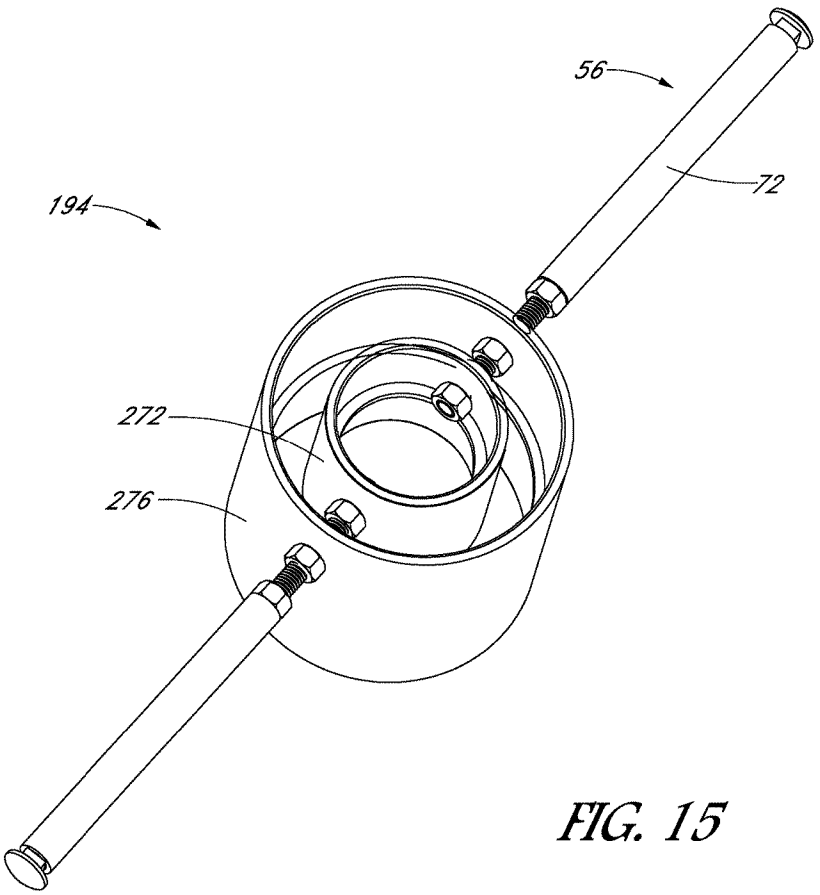
FIG. 15 is a perspective view of the handle assembly of the hole digger of FIG. 10.

The primary rotational motive force for the digger head and scraper blades is produced at the housing handle assembly 194 shown in FIG. 15. The motive force is preferably bi-directional and oscillating. Such manner of rotational force application results in an increase the soil disturbance by the scraper blades, a maximization of the turbulent airflow in the digging area, and a maximization of the saltation process to reduce soil particle size in a similar manner to the leaping movement of particles resulting from the geologic forces of wind and running water.

The housing handle assembly 194 includes a central handle joiner 272 with a central opening through which extends the central vacuum tube 186. The handle joiner 272 is nested within a handle assembly outer housing 276, preferably fabricated using a PVC coupling. As discussed with the handle assembly 32 used with the post hole digger, the housing handle assembly 194 includes outer handle covers or sleeves that freely rotate around inner metal tube handles. Such rotation enables a user to rotate the Digger ergonomically, without causing blisters on bare hands. The housing handle assembly 194 is preferably assembled using hardware that includes ½-inch nuts and bolts as previously discussed.

Figure 16:
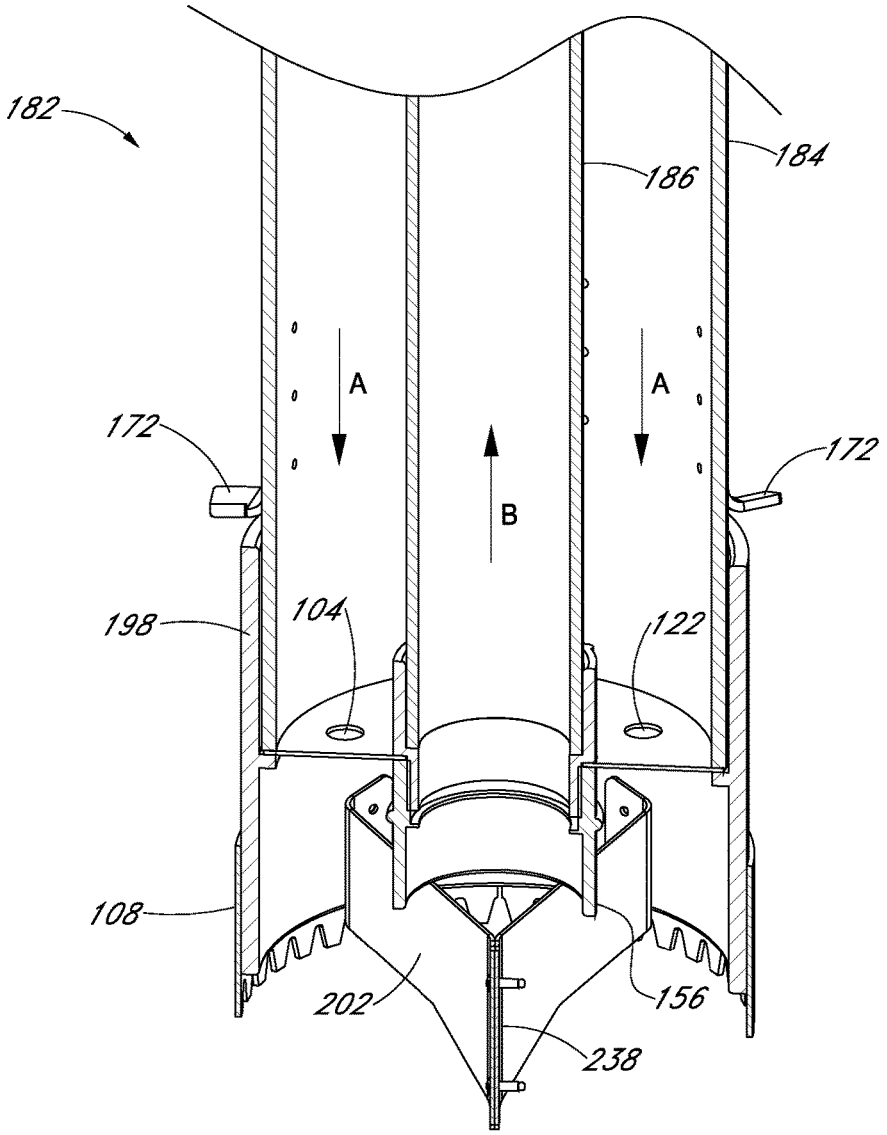
FIG. 16 is a partial top perspective view, taken in cross-section, of the digger head assembly connection to the hole digger of FIG. 10.

FIG. 16 shows a partial cross-section of the downhole end of the outer housing hole digger 182. The housing scraper blade assembly 202 and the saw blade 108 lie within the digger head, and both function to pulverize the soil to produce small soil particles having a threshold velocity lower than the wind velocity created within the digger head resulting in their entrainment in the airflow within the digger head.

Atmospheric air flowing downhole through the circular outer housing 184, in the direction shown by Arrow A enters the digger head through the plurality of air entry apertures 122 formed in the orifice plate 104. The total area of the air entry apertures is less than the cross-sectional area of the central vacuum tube 186, accelerating the air through the digger head before the evacuation of the air and entrained soil particles through the central vacuum tube in the direction of Arrow B.

FIG. 16 also shows the addition of the reamer blades 172 attached to the circular outer housing 184. The reamer blades are positioned above the PVC coupling 198, to ream the six-inch hole formed by the PVC coupling to a larger hole diameter, such as eight inches.

Figure 17:
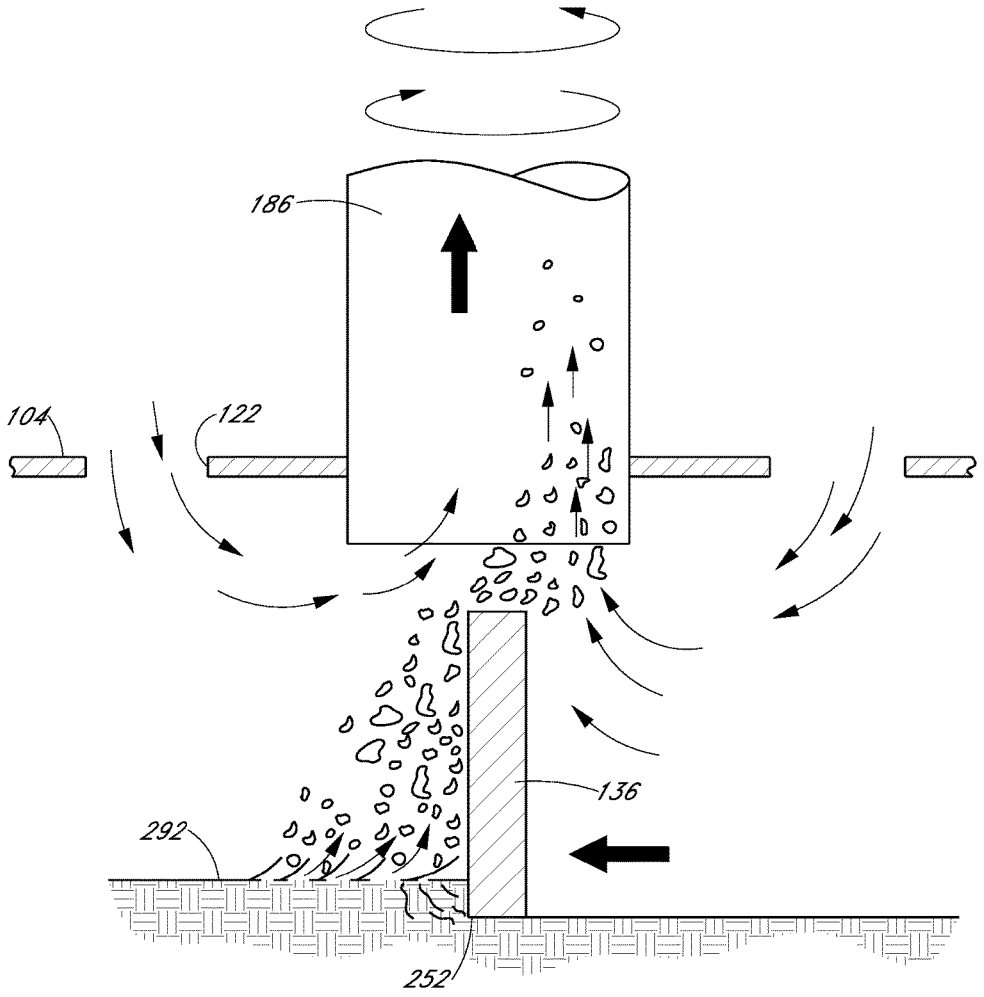
FIG. 17 is a schematic illustration of the airflow and particulate movement within the digger head assembly while in operation.

Wind erosion studies reveal the rate of soil transport is most affected by wind speed and soil particle size. FIG. 17 schematically illustrates the structures of the present invention that create higher airflow velocities and smaller particle size to enhance particle transport and digger head efficiency. Placement of the orifice plate on the top surface of the digger head, and constraining the total area of the orifice apertures to be less than the cross-sectional area of the vacuum tube enables the creation of sub-atmospheric pressure within the digger head upon activation of the vacuum source, with the bottom opening of the digger head effectively sealed as the digger bores downward into a soil face 292.

The flow of air down the outer housing increases in velocity as it passes through the orifice apertures, accelerating as it flows into the vacuum tube. Soil particle transport increases exponentially as wind velocity increases, which is one beneficial effect of the increased air velocity through the digger head.

Particle transport is a function of wind velocity, surface roughness, particle size, and the percentage of detached particles. The scraper blades with their scraper edges 252 and scraper dowels (not depicted in FIG. 17) act upon the soil face 292 to enhance surface roughness by disturbing the soil, and also serve, through their oscillating, scraping actions, to form soil particles of decreasing particle size. As the scraper blades move back and forth over the soil surface, the previously generated particles bounce and abrade against one another, which acts to break down the soil particles into smaller and smaller particles.

As depicted in FIG. 17, the smaller particles effectively travel up the "wall" of the scraper blade, and when enough particles accumulate in front of the blade, tumble over the windward edge, where they fall into an accelerating airflow stream. Such particle flow over the edge, effectively launching the particles into the airstream, enhancing their entrainment.

By way of example and not limitation, FIGS. 11-16 and the following narrative provides general guidance regarding a presently preferred manner of assembling the vacuum-assisted outer housing hole digger of the present invention. The saw blade is preferably cut from 16-gauge cold rolled steel, and has the three sets of multiple apertures discussed previously in the context of FIG. 12. One set assists in vertically positioning the saw blade at the end of the PVC coupling. The second set of apertures receive rivets used to attach the saw blade to the coupling. The third set of apertures receive rivets attaching the scraper assembly to the coupling.

The 6-inch PVC coupling used to form the digger assembly is slightly tapered with one end larger than the other enabling its release from the mold after injection forming. Once identified, the larger end receives the saw blade. The saw blade may be sized to fit the smaller end of the coupling without degrading performance should it be placed in the larger end.

Four rivet mandrels (or like-shaped objects) are inserted in the attachment apertures of the blade. With the blade positioned teeth-up, the saw blade is lowered onto the coupling until the mandrels rest on the edge of the coupling. A hand drill utilizes the positioning apertures as a guide when forming the holes in the coupling. Saw blade attachment apertures and aligned coupling holes receive rivets (⅛-inch steel rivets are presently preferred). After attachment, the rivet mandrels are removed from the attachment apertures.

Saw blade positioning apertures guide a hand drill to form corresponding apertures in the coupling. Each scraper blade has a pair of apertures formed in the attachment flanges (see FIGS. 13 and 14) and these flange apertures align with the apertures formed above. Rivet mandrels are inserted into one of each pair of these scraper attachment apertures, placing the scraper blade assembly in proper alignment before attachment. Rivets again provide the preferred connector; a hand-operated rivet gun is securely attaching the scraper blade assembly to the coupling.

Fabricating the vacuum assembly begins by cutting a 2-inch PVC vacuum tube to a length that is approximately 2 feet longer than the length of the 6-inch PVC sewer pipe used for the outer housing. The orifice plate is received between the male and female parts of the 2-inch threaded coupling. An end of the cut 2-inch vacuum tube is inserted into the male threaded coupling. The vacuum tube/orifice plate assembly is received within an end of the 6-inch length of sewer pipe until the orifice plate touches the end of the 6-inch length of sewer pipe.

The orifice plate with attached tube and 6-inch sewer pipe is slid down the upper end of the digger head assembly coupling and positioned against the orifice plate support within the digger head assembly coupling. The orifice plate fits tightly against the orifice plate support. The sewer pipe housing is pressed tightly into the digger head assembly coupling, capturing the vacuum assembly orifice plate between the sewer pipe housing and the orifice plate support. The digger assembly coupling is then snugly fit to the base of the sewer pipe housing. A mallet may be necessary to affect the snug fit.

FIG. 15 shows a presently preferred embodiment where the handle assembly is separately constructed for later attachment to the digger tube. A 4-inch PVC coupling is captured inside a 6-inch PVC coupling, using two ½-inch by 12-inch carriage bolts and ten ½-inch nuts. The resultant open passageway within the 4-inch coupling receives the 2-inch PVC pipe of the vacuum assembly. The nuts on the ½-inch by 12-inch carriage bolts tightly secure the 4-inch PVC coupling in the center of the 6-inch PVC coupling.

Each handle bolt is held in position with two ½-inch nuts, one on each side (against the inner and outer walls) of the 6-inch PVC coupling. This manner of positioning also centers the central coupling (sometimes referred to as the "handle joiner"), inside the 6-inch PVC coupling.

Upon completion the handle assembly slides onto the outer end of the digger tube, forming a strong handle capable of transferring rotational torque to the 6-inch digger tube housing. Under normal conditions, the 6-inch PVC handle assembly coupling need not be glued or riveted to the digger tube. The interference fit and friction between the inner wall of the coupling and the outer wall of the digger tube is normally sufficient for the amount of user-applied rotational torque. Where conditions require greater amount of applied torque, rivets are preferably used to attach the handle assembly coupling to the digger tube.

Where excessive torque is likely to be required or to provide a more rugged handle assembly, the 4-inch PVC coupling can be replaced with a handle joiner formed of metal, such as might be fabricated using a thin wall, approximately ⅛-inch steel 3-inch pipe cut to around 2 inches in length. Two ½-inch nuts welded on opposite sides of the pipe wall provide of metal handle joiner that is stronger and more durable than when the handle joiner is fabricated out of PVC. The nut adjacent the nut welded to the handle joiner functions as a lock nut, securing the carriage bolt handle to the handle joiner.

The two nuts on both sides of the 6-inch coupling tighten together, securely capturing the PVC coupling. The fifth nut, located at the end of each carriage bolt, captures a ½-inch PVC pipe on the carriage bolts, which is gripped by the operator during use of the digger. The captured ½-inch PVC pipe rotates about the carriage bolt as the operator rotates the digger in a back-and-forth manner, reducing the frictional wear that would otherwise be experienced by the operator.

In an alternate manner of assembly, the handle assembly coupling is placed over and snugly received by the outer end of the sewer pipe housing. A mallet may be used to pound on the handle assembly coupling to effect the snug fit. The inner handle joiner is placed over and around the projecting end of the vacuum tube and lowered into position to receive the two handles extending within the handle assembly coupling. A hose connector attached to the outer end of the vacuum tube completes the digger assembly.

A reamer assembly add-on (shown in Photograph 8) may be used to obtain holes having a larger diameter than the 6-inch diameter of the outer housing. A plurality of reamer blades are attached to the outside of a 10-inch length of 6-inch PVC D3034 Sewer Pipe that has been inserted into a 6-inch PVC coupling. The coupling edge acts as a gauge for blade placement around the circumference of the sewer pipe, with the blades snug against the received edge of the coupling.

Attaching the reamer blade pipe and coupling lengthens the digger unit. To accommodate this longer length requires lengthening the centrally located vacuum extraction tube. At times, such as when enlarging existing holes, the digger requires only the reamer assembly, permitting removal of the digger head assembly from the digger.

The following discussion illustrates a presently preferred manner of using the vacuum-assisted circular housing hole digger of the present invention, by way of example and not limitation. FIG. 1 shows a shop vacuum cleaner providing the vacuum source. This invention is not limited to use with shop vacs, and a variety of vacuum sources can power the digger of the present invention. As one example, the digger can be powered by the suction side of a motorized blower, such as a Keene Engineering HVS Blower. The blower attaches to the digger with a two ½-inch suction hose. The rate of progress when digging through a sandy, clay or loam soil with less than 10% moisture was substantial, often at a rate of 5 inches per minute.

Activation of the vacuum source establishes an airflow circulation within the digger. The air flowing into and through the annular passageway of the outer digger housing is laminar, minimizing airflow resistance and maximizing the mass flow rate of air into the digging area for the particular vacuum power source in use (rate of airflow/horsepower). The airflow encounters the smaller openings formed in the orifice plate, and maintaining that flow rate requires an increase in the velocity of the air as it passes through the restricted diameter openings and flows into the digging area inside of the digger head assembly.

The combined cross-sectional area of all orifice apertures is slightly less than the cross-sectional area of the vacuum extraction tube. As a result, the air pressure within the digging head/working area is less than the atmospheric pressure within the annular space in the housing and greater than the air pressure within the vacuum extraction tube.

Such pressure differential maximizes the mass flow rate and velocity of the air as it enters the working area, crosses the digger head work area, and exits into the vacuum extraction tube. The restricted diameter of the extraction tube maintains a sufficient airflow velocity to keep the particles suspended until they drop out into the catch container of a shop vac or upon emerging from a blower discharge opening. The limiting factor controlling the depth of the hole is the airflow velocity drop in the vacuum extraction line. As long as the airflow velocity in the vacuum extraction line exceeds the particle threshold velocity, the digger is capable of digging deeper.

Shop vacs operate in the 6 to 12-amp range at 110 volts, with hose diameters of 2 to 2½ inches, obtaining flow rates of 150 to 200 $ft^3$ per minute (CFM). Such airflow rates are more than adequate for effective operation of the digger. For example, in hard-packed clay with sand and gravel combined, the digger can bore a hole at the rate of 1 inch per minute. As an example, attachment of the digger using a 2-inch hose to a LOWE'S® brand 14-gallon shop vac rated at 12 amps at 110 volts, with an indicated 6.5 peak horsepower. Digging commences by rotating the digger clockwise and counterclockwise, back and forth, approximately 90 degrees by hand with the shop vac running and pulling a vacuum. The pulverized ground is sucked into the shop vac. A one-foot deep hole of 6-inch diameter will produce about three gallons of dirt, weighing about 50 pounds.

In many cases, a smaller shop vac is appropriate; a 5-gallon shop vac (typically) can easily be lifted for dumping the removed soil into a wheelbarrow. A five-foot deep hole will produce roughly fifteen gallons of dirt, which will weigh in at over 250 pounds. Weights of this magnitude start pushing the structural integrity of most non-commercial vacuum cleaners. Commercial models provide larger wheels and strong, sturdy handles for moving.

The high airflow rates achieved within the digger assist in breaking the soil apart and reducing it to powder, which is easily carried away. Diggers are capable of reducing hard-packed clay and gravel soil to powder, and hard sand and gravel.

One skilled in the art will appreciate that the foregoing embodiments are illustrative of the present invention. The present invention can be advantageously incorporated into alternative embodiments while remaining within the spirit and scope of the present invention, as defined by the appended claims.

What is claimed is:

1. A vacuum-assisted hole digger, comprising:

a vacuum tube having a proximal end and a distal end with a through bore extending therebetween, the proximal end configured to selectively connect with a vacuum source and the distal end configured as an intake opening having an interior diameter; and a digger head assembly attached to the distal end of the vacuum tube and in fluid communication therewith, the digger head assembly comprising:

a digger housing comprising:

an orifice plate attached to the vacuum tube, the orifice plate having formed therein a central vacuum extraction aperture, and outwardly therefrom, a plurality of air entry apertures forming an aperture array, whereby upon attachment of the orifice plate to the vacuum tube, the central vacuum extraction aperture aligns and is coextensive with the interior diameter of the intake opening of the vacuum tube, and a saw blade attached to and extending about a periphery of the orifice plate, and projecting in a vertical manner from the attachment to the orifice plate, a terminal edge of the saw blade defining a bottom opening of the digger housing, and a scraper blade assembly disposed within and attached to the digger housing, the scraper blade assembly having at least one scraper blade that extends toward the bottom opening of the digger housing, the scraper blade having a terminal edge defining a scraping edge that is configured to abrasively engage with a soil face upon initiation of the hole digging.

2. The vacuum-assisted hole digger of claim 1, wherein the orifice plate is selected such that the diameter of each of the plurality of air entry apertures provide a plurality of areas, and the combined total of the plurality of areas is less than the area of the central vacuum extraction aperture.

3. The vacuum-assisted hole digger of claim 2, wherein each of the plurality of air entry apertures have an identical diameter.

4. The vacuum-assisted hole digger of claim 2, and further comprising a handle assembly attached to the vacuum tube adjacent to the proximal end, the handle assembly comprising:

an outer sleeve received within and extending from the proximal end of the vacuum tube; and a pair of handles attached to and extending on opposite sides from the outer sleeve.

5. The vacuum-assisted hole digger of claim 4, and further comprising an outer handle cover slidably received over and secured to each of the pair of handles, wherein securement of the outer handle cover is in a manner that enables the outer handle cover to rotate about the inner handle.

6. The vacuum-assisted hole digger of claim 4, wherein an outer end of the outer sleeve of the handle assembly is configured as a vacuum hose adapter.

7. The vacuum-assisted hole digger of claim 4, wherein a plurality of scraper blades are attached to and extend from the digger housing.

8. The vacuum-assisted hole digger of claim 7, and further comprising a plurality of scraper dowels attached to the scraper blade assembly in a manner such that end portions of the scraper dowels project beyond the bottom opening of the digger housing.

9. A vacuum-assisted hole digger, comprising:

an elongated tube having a first end and a second end, the first end configured for selective connection with a vacuum source and the second end configured as an intake opening;

an orifice plate attached to the elongated tube at the intake opening, the orifice plate having a vacuum extraction aperture centrally formed therein and a plurality of air entry apertures formed in the orifice plate at locations outward of the vacuum extraction aperture, the plurality of air entry apertures defining an array, wherein upon attachment of the orifice plate to the elongate tube, the vacuum extraction aperture is coextensive with an inner diameter of the intake opening;

a housing received about an outer periphery of the orifice plate and extending perpendicularly therefrom in a manner defining a digger housing, a terminal edge of the digger housing defining a bottom opening of the digger housing; and a scraper blade assembly received within and attached to the digger housing, the scraper blade assembly having a plurality of scraper blades, each scraper blade extending toward the bottom opening of the digger housing and each scraper blade having a terminal edge defining a scaping edge that is configured to abrasively engage with a soil face upon initiation of the hole digging.

10. The vacuum-assisted hole digger of claim 9, wherein the orifice plate is selected such that the diameter of each of the plurality of air entry apertures provide a plurality of areas, and the combined total of the plurality of areas is less than the area of the vacuum extraction aperture.

11. The vacuum-assisted hole digger of claim 10, wherein each of the plurality of air entry apertures have an identical diameter.

12. The vacuum-assisted hole digger of claim 10, and further comprising a handle assembly attached to the elongated tube adjacent to the first end, the handle assembly comprising:

an outer sleeve received within and extending from the first end of the elongated tube; and a pair of handles attached to and extending on opposite sides from the outer sleeve.

13. The vacuum-assisted hole digger of claim 12, and further comprising an outer handle cover slidably received over and secured to each of the pair of handles, wherein securement of the outer handle cover is in a manner that enables the outer handle cover to rotate about the inner handle.

14. The vacuum-assisted hole digger of claim 12, wherein an outer end of the outer sleeve of the handle assembly is configured as a vacuum hose adapter.

15. The vacuum-assisted hole digger of claim 9, wherein the housing comprises a saw blade attached to the outer periphery of the orifice plate and wherein a plurality of saw teeth extend from and about the terminal edge of the digger housing.

16. A vacuum-assisted hole digger comprising:

a vacuum tube having a proximal end and a distal end with a through bore extending therebetween, the proximal end configured to selectively connect with a vacuum source and the distal end configured as an intake opening;

a circular outer housing surrounding the vacuum tube defining an annular cavity between the vacuum tube and an inner wall of the circular outer housing, the annular cavity configured to receive atmospheric air from an open end of the circular outer housing adjacent the proximal end of the vacuum tube, a housing handle assembly connecting the vacuum tube to the outer housing at the proximal end of the vacuum tube, the housing handle assembly including a central handle joiner having a central opening through which extends the vacuum tube, the handle joiner nested within a handle assembly outer housing, the handle outer housing dimensioned to form an interference fit upon receipt of an upper section of the circular outer housing within a lower section of the handle outer housing; and a digger head housing having a circular outer wall defining an upper section and a lower section, the upper section receiving a lower section of the circular outer housing, the upper section configured to form an interference fit with the lower section, the digger head housing further comprising:

an orifice plate support formed within the digger head housing and annularly extending to circumferential attachment to an inner surface of the outer wall of the digger head housing, an orifice plate received upon the orifice plate support, the orifice plate having a central aperture formed therein and coextensive with the intake opening of the vacuum tube, and a plurality of air entry apertures formed in the orifice plate and arranged in an outer annular section of the orifice plate, the outer annular section extending within the annular cavity of the circular outer housing, a scraper blade assembly received within the digger head housing and attached to the outer wall at a location below the orifice plate support, and a saw blade attached to the outer wall of the digger head housing, the saw blade positioned such that a plurality of projecting saw blade teeth extend beyond a terminal edge of the digger head housing, whereby, upon connection of the vacuum tube with a vacuum source, atmospheric air within the annular cavity of the circular outer housing initiates an airflow into the digger head housing, entraining such soil particles as are formed through action of the scraper blade assembly therewithin, entering the intake opening of the distal end of the vacuum tube prior and its subsequent exhaustion through the proximal end of the vacuum tube, removing such soil particles from the hole digger.

* * * * *